United States Patent [19]

Brown

[11] 3,994,346

[45] Nov. 30, 1976

[54] INVESTMENT SHELL MOLD, FOR USE IN CASTING OF REACTING AND REFRACTORY METALS

[75] Inventor: Robert A. Brown, Albany, Oreg.

[73] Assignee: REM Metals Corporation, Albany, Oreg.

[22] Filed: June 17, 1974

[21] Appl. No.: 479,771

Related U.S. Application Data

[60] Continuation of Ser. No. 308,931, Nov. 24, 1972, abandoned, which is a division of Ser. No. 149,485, June 3, 1971, Pat. No. 3,743,003.

[52] U.S. Cl. ..... 164/361; 106/38.9; 106/38.27; 427/133; 427/134

[51] Int. Cl.[2] ..... B22C 9/02

[58] Field of Search ..... 117/5.1, 5.2; 164/16, 164/26, 72, 25, 361; 106/38.9, 38.27, 38.35; 427/133, 134, 380; 249/114, 115

[56] References Cited

UNITED STATES PATENTS

| | | | |
|---|---|---|---|
| 1,981,403 | 11/1934 | Weitzenkorn | 117/5.1 |
| 2,618,032 | 11/1952 | Traenkner | 249/114 |
| 3,125,787 | 3/1964 | Lirones et al. | 164/24 |
| 3,422,880 | 1/1969 | Brown et al. | 164/26 |

*Primary Examiner*—Ronald H. Smith
*Assistant Examiner*—Dennis C. Konopacki
*Attorney, Agent, or Firm*—Eugene D. Farley

[57] ABSTRACT

An investment shell mold inhibited against reaction with molten titanium, zirconium and other reactive and refractory metals cast therein is made by investing a pattern with successive dip coats and stucco coats. The first dip coat includes a tungsten and/or molybdenum compound inhibitor-former which is reducible by hydrogen to metallic tungsten or molybdenum. After removal of the pattern, the green mold is dried and then pyrolyzed in an atmosphere of hydrogen under conditions predetermined to convert the inhibitor-former to metallic condition. This creates on the mold interface a coating of metallic molybdenum or tungsten which serves as a physical barrier, inhibiting reaction of a molten reactive or refractory metal subsequently cast in the mold, with the mold material and binder particles of the latter.

7 claims, 1 Drawing Figure

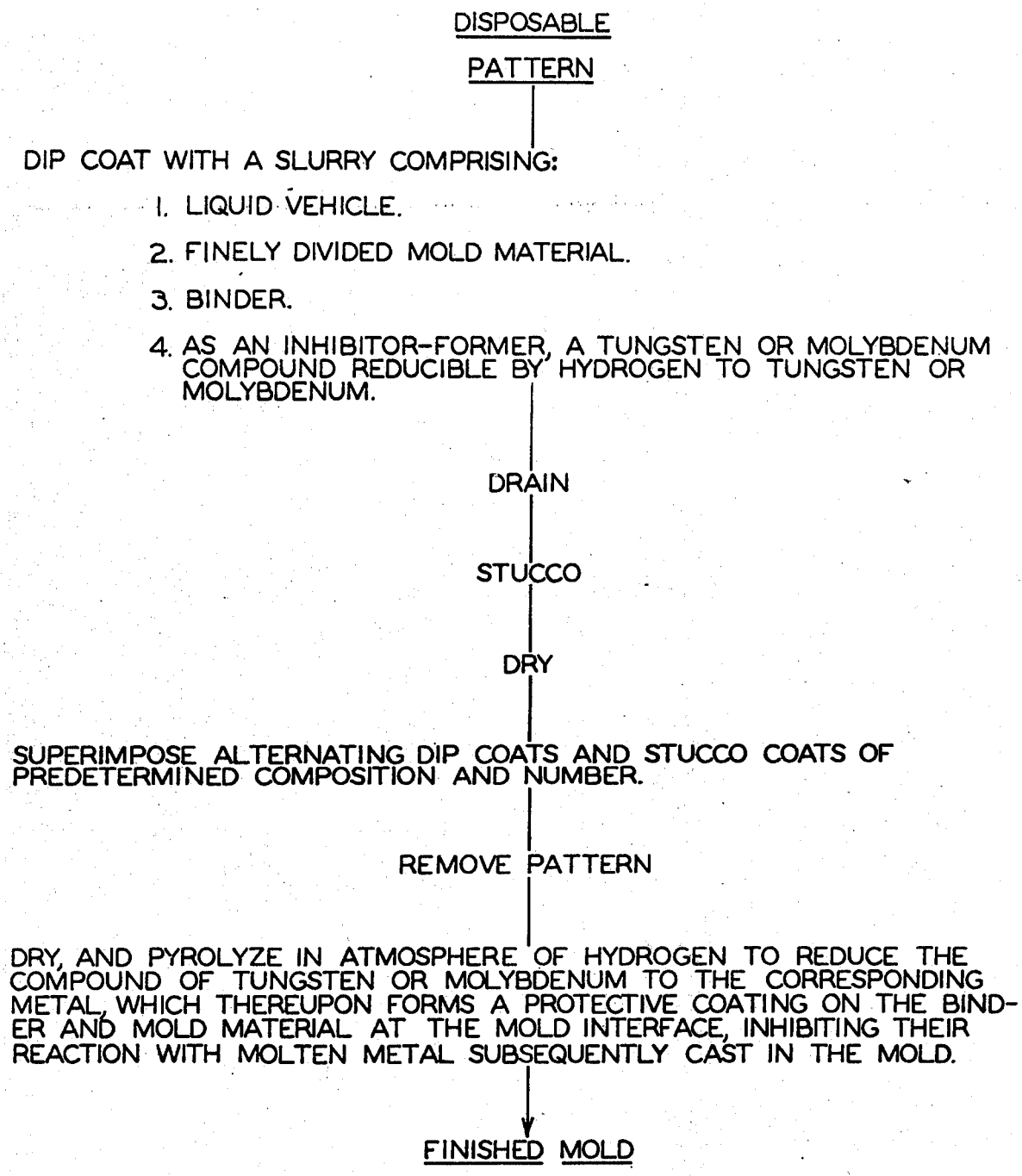
DISPOSABLE
PATTERN
DIP COAT WITH A SLURRY COMPRISING:
1. LIQUID VEHICLE.
2. FINELY DIVIDED MOLD MATERIAL.
3. BINDER.
4. AS AN INHIBITOR-FORMER, A TUNGSTEN OR MOLYBDENUM COMPOUND REDUCIBLE BY HYDROGEN TO TUNGSTEN OR MOLYBDENUM.
DRAIN
STUCCO
DRY
SUPERIMPOSE ALTERNATING DIP COATS AND STUCCO COATS OF PREDETERMINED COMPOSITION AND NUMBER.
REMOVE PATTERN
DRY, AND PYROLYZE IN ATMOSPHERE OF HYDROGEN TO REDUCE THE COMPOUND OF TUNGSTEN OR MOLYBDENUM TO THE CORRESPONDING METAL, WHICH THEREUPON FORMS A PROTECTIVE COATING ON THE BINDER AND MOLD MATERIAL AT THE MOLD INTERFACE, INHIBITING THEIR REACTION WITH MOLTEN METAL SUBSEQUENTLY CAST IN THE MOLD.
FINISHED MOLD

INVESTMENT SHELL MOLD, FOR USE IN CASTING OF REACTING AND REFRACTORY METALS

This is a continuation of now abandoned application Ser. No. 308,931, filed Nov. 24, 1972 which is a division of Ser. No. 149,485, filed June 3, 1971, now U.S. Pat. No. 3,743,003.

BACKGROUND OF THE INVENTION

This invention relates to methods for making investment shell molds for the high integrity, precision casting of reactive and refractory metals, and to the molds prepared by such methods.

In one method of making inventment shell molds (Brown et al U.S. Pat. No. 3422880), a disposable pattern is dip coated in a liquid suspension of columbium, molybdenum, tantalum or tungsten powder mold material and a metal oxide binder. The dip coated pattern is stuccoed with at least one of these metal powders, after which it is dried.

Additional dip coats and stucco coats of predetermined composition are applied in number sufficient to build up a finished mold of the desired composition and strength. The pattern is removed and the mold fired. It then is ready to receive molten titanium or other reactive and refractory casting metals.

The foregoing method of making a shell mold is highly useful and has the important advantage of producing a high integrity mold of precise dimensions. However, under certain conditions, the highly reactive molten metal poured into the mold may react chemically with the mold material and/or the metal oxide binder to produce a defective casting.

For example, if a zirconium dioxide binder is used in the fabrication of the mold, it may be reduced by molten titanium with the production of zirconium suboxides and oxygen. The latter reacts with the molten titanium, causing alpha phase stabilization and resulting in the production of a defective casting with an embrittled surface. Also, the zirconium suboxide products, some of which are gases at the casting temperature, have the potential of producing porosity in the casting.

It is the object of the present invention to provide a method which overcomes this problem and which produces a mold free from the above noted defects.

SUMMARY OF THE INVENTION

It is the essence of the present invention that the desired result may be obtained by including in at least the face dip coat slurry a proportion of a tungsten or molybdenum compound which is reducible to the free metal, and thereafter firing the green mold in an atmosphere of hydrogen, thereby forming a metallic coating on the metal oxide binder and mold material of the mold face coat. This provides a physical barrier against reaction of the mold face coat constituents with molten titanium or other reactive or refractory metal subsequently introduced into the mold. This, in turn, inhibits the conversion of such constituents to undesired gases and other products, which, if produced, would degrade the casting.

Considering the foregoing in greater detail:

The method of the invention is applicable to the manufacturing of molds useful in the high integrity precision casting of the reactive and refractory metals including zirconium, hafnium, molybdenum, columbium, tantalum and titanium.

The method makes use of a pattern which may be made of any of the disposable materials customarily employed in the manufacture of investment shell molds. Thus it may be made by conventional techniques from waxes, plastics, or other materials which readily are removed from the mold after its formation. Each pattern is made by injecting the selected pattern material in the fluid condition into a die, permitting it to solidify, removing it from the die and, if desired, gating the resulting pattern to a central sprue to form a pattern cluster.

The investment shell mold of this invention preferably is produced by a method illustrated in the accompanying drawing.

BRIEF DESCRIPTION OF THE DRAWING

The single FIGURE is a flow plane of a method by which to produce an investment shell mold embodying the features of this invention.

DESCRIPTION OF THE PREFERRED EMBODIMENT

As indicated in the flow plan, comprising the single FIGURE of the drawings, the method of the invention is included in the procedure for making investment shell molds by subjecting the pattern cluster to an investment cycle which includes the steps of dipping the cluster into an agitated slurry of the mold material, draining, stuccoing (optionally) while still wet with particulate mold material in a fluidized bed or by sprinkling, and drying to a solvent content of preferably less than 20% by volume. The dipping, draining, stuccoing and drying sequence is repeated a desired number of times to produce a laminated investment shell mold of the desired thickness and strength.

The coats of mold-forming material thus applied in general are of three categories:

The first coat is termed the "face coat". It constitutes the inner face of the mold and is in direct contact with the molten metal poured therein. A single dip coat-stucco coat combination normally comprises the face coat.

The second category of coats, termed the "adjacent face coats", comprise alternate dip coats and stucco coats applied in sequence on top of the face coat. There may be any desired or necessary number of such coats.

The third class of coats applied in making the herein described molds are those which, during use of the molds, normally do not come in direct contact with the molten casting metal, or with the vapor produced therefrom. These are termed "back-up coats" and comprise alternate dip coats and stucco coats applied in sufficient number to add the required strength to the mold. There normally may be a total of 12 or more adjacent face and back-up coats applied to the pattern in building up a mold.

After completion of the investment procedure, the disposable pattern is removed from the mold shell by a method such as melting or solvent treatment. The mold is dried in an oven to remove low temperature volatiles. Next, it is cured by firing in a hydrogen-containing atmosphere at a temperature sufficiently elevated to remove high temperature volatiles, and provide adequate bonding.

In use of the mold, it is heated and filled with molten metal by gravity, pressure or centrifugal force. After cooling, the mold is removed from the resulting casting, the casting removed from the sprue and finished in the usual manner.

In accordance with the present invention, the foregoing sequence is modified by covering the particles of metal oxide binder and mold material at the mold interface with a metallic coating. This forms a barrier which serves the important function of inhibiting the above noted undesirable reactions between the molten casting metal and the mold face coat constituents when the molten metal is introduced into the mold.

To achieve this result, at least the face coat of the mold is prepared by dipping the pattern in a slurry having the following general composition:

1. Finely divided mold material.
2. Metal oxide binder or compound pyrolyzable to the same.
3. Inhibitor-former of tungsten or molybdenum compound which is reducible by hydrogen to tungsten or molybdenum.
4. Liquid vehicle.

The method of the invention is applicable to the preparation of molds having face coats containing as primary constituents a variety of finely divided mold materials. Thus, such materials may comprise finely divided oxides characterized by having high melting points and the high stability resulting from having high free energies of formation. Illustrative of such oxides are zirconium dioxide, aluminum oxide and magnesium oxide.

Metallic molybdenum and tungsten in the form of their finely divided powders are particularly well suited for use as primary face coat mold materials in the compositions of the present invention. This is because of their lack of a normal tendency to form casting-damaging intermediate metallic compounds with the various reactive and refractory casting metals, and their freedom from a tendency to react with such metals to form gases which might contaminate the castings.

Such metal powders may be used singly or admixed with each other. They may be used in the form of the pure metals, their alloys, or their unalloyed mixtures. They are employed in finely divided, graded condition, having a particle size, for example, in the range of from below 400 mesh to 5 mesh U.S. Sieve Series, i.e. having a particle size of from 0.1 to 4000 microns.

The metal oxide binders employed in the face coat of the presently described systems in general comprise certain refractory metal oxides or compounds pyrolyzable to such oxides. These are used in the liquid state, in a dissolved condition, or as solids suspended or dispersed in aqueous or other liquid media.

In general those metal oxides are preferred as binders which are oxides of the group 3 and group 4 metals in the Mendeleevian periodic chart (as set forth on page 30 of "Advanced Inorganic Chemistry" by F. G. Cotton and G. Wilkinson; Interscience Publishers, 1962), which have a free energy of formation at 1000° K, greater than 69 kilocalories per gram atom of oxygen in the oxide, which melt after pyrolyzation at a temperature of more than 1000° K, which bond upon pyrolyzation and which provide a high temperature bond for the mold material particles.

Preferred binders of this class are the oxides, or the compounds which form oxides upon pyrolysis, of zirconium, thorium, hafnium, yttrium, and gadolinium.

Illustrative of compounds which form such oxides upon pyrolysis are the polymeric carboxylates, such as diacetato zirconic acid (zirconium acetate); the basic oxyhalogenides; the metal-organic compounds, particularly the alkoxides; the alkoxide alcoholates; the oxide alkoxide alcoholates; the polymeric alkoxides; and the oxide alkoxides; the hydrolyzed alkoxides; the halogenated alkoxides, and the hydrolyzed halogenated alkoxides; of zirconium, thorium, hafnium, yttrium and gadolinium. Upon pyrolysis, the foregoing are converted to metal oxide binders which normally nature and cure below the sintering temperature of the mold material components of the facing and adjacent facing systems, and thus normally ideally serve the purposes of the invention.

Other binders which may be employed comprise various phosphates such as magnesium phosphate and such conventional binders as calcium aluminate and sodium silicate. All of these binders, however must meet the minimum free energy of formation requirement of at least 69 kilocalories per gram atom of contained oxygen at 1000° K, and the minimum melting point requirement of 1000° K, after pyrolyzation.

The third major constituent of the mold face coat slurry is an inhibitor having the ability to inhibit the deleterious reactions which may occur between some molten reactive and refractory metals cast in the mold with the various face coat mold materials and metal oxide binders employed in making the mold.

The inhibiting materials useful for this purpose belong to the class of compounds which are susceptible to reduction in the hydrogen environment of the mold firing furnace to form a coating of metal on the particles of metal oxide binder and mold material. This coating is not completely continuous, since gaseous products are formed during its deposition. However, the discontinuities are in the form of tiny openings which are so small as to be substantially impenetratable by the molten casting metal because of the surface tension properties of the latter. The coating accordingly acts as a physical barrier which retards attack on the binder and mold material by the molten casting metal. It also acts as a close proximity heat sink.

The selection of a suitable inhibitor is difficult because of the environment of its use and the critical problems which are present.

Thus, the inhibitor should have a sufficiently low free energy of formation so that it may be reduced to elemental metal rapidly by hydrogen.

Physically, it must be soluble, or at least dispersible, in the liquid vehicle employed in the formulation of the dip coat slurry so that a substantially uniform barrier coat may be produced.

It also must be reducible to a metal which is sufficiently high melting so that it will not be washed off the particles of mold material and oxide binder by the molten titanium or other metal being cast in the mold.

I have discovered that, of all the commercially and practically available metal-forming inhibitors, certain molybdenum- and tungsten-containing compounds uniquely are suited for this intended purpose. The behavior of these two metals is in sharp contrast to the behavior of other metals such as iron, nickel, copper, cobalt, silver, gold, zinc and lead. These react readily with reactive and refractory casting metals such as titanium and zirconium, forming intermetallic compounds which affect deleteriously the properties of the resulting casting.

Specifically, there may be employed the following classes of compounds of molybdenum and tungsten:

The oxides of molybdenum and tungsten, including molybdenum dioxide, molybdenum trioxide, tungsten dioxide, and tungsten trioxide.

The acids of tungsten and molybdenum and the salts thereof. Such compounds include molybdic acid, tungstic acid, ammonium metatungstate, and ammonium paratungstate.

There also may be employed double salts of tungsten and molybdenum containing other metals. Such compounds are lanthanum metatungstate and yttrium metatungstate. It should be noted, however, that such double compounds are only partially reducible by hydrogen to elemental metal. Thus, when lanthanum metatungstate is employed as an inhibitor, the tungsten oxide component is reduced to metallic tungsten in the desired manner. The lanthanum oxide component, however, is not thus reduced, but remains innocuously as lanthanum oxide.

A third class of inhibitor-formers comprises the alkoxides and halogenated alkoxides of molybdenum and tungsten. These are prepared by reacting the corresponding metal halides with an alcohol having, for example, from 1 to 5 carbon atoms. Important examples for the present purposes are molybdenum ethoxide ethylate tungsten ethoxide ethylate, molybdenum chlorethoxide ethylate, tungsten trichloro diethoxide ethylate, and tungsten trichloro dimethoxide.

Still a further class of inhibitor-formers useful for the present purpose comprise the halides and oxyhalides of molybdenum and tungsten. In particular, the chlorides and oxychlorides are of significance. Examples are molybdenum pentachloride, molybdenum oxytrichloride dimolybdenum oxyoctachloride, dimolybdenum trioxypentachloride, molybdenum dioxydichloride, molybdenum oxytetrachloride, tungsten hexachloride, tungsten dioxydichloride, and tungsten oxytetrachloride.

These and other inhibitor-formers may be used singly or in combination with each other in the formulation of the face coat slurries employed in the method of the present invention.

Another principle constituent of the face coat slurry comprises a liquid vehicle for the aforementioned materials, i.e. the mold material, the binder, and the inhibitor-former. Such vehicle may comprise water, or various organic solvents, especially the lower aliphatic alcohols having fewer than four carbonatoms, i.e. methyl alcohol, ethyl alcohol, and the propyl alcohols. Admixtures of water and other water soluble organic solvents also may be employed.

In addition to the mold materials, binders, inhibitor-formers and suspension or dispersion vehicles of the above described systems, there may be employed a suitable quantity of conventional additives such as suspension agents, green strength promoters, plasticizers, wetting agents, anti-foaming agents, deflocculants, and coating driers.

The relative proportions of the constituents employed in the face coat slurry are somewhat variable, depending upon particular applications. However, the metal oxide binder normally is employed in an amount of from 0.01 to 50.0% by weight of the mold material slurry. The tungsten- or molybdenum-forming inhibitor is employed in at least the amount required for forming the coating of inhibiting metal on the metal oxide binder particles and the face coat mold material. The liquid vehicle is employed in amount sufficient to impart the desired viscosity to the dip coat slurry. Suitable viscosities lie within the broad range of 50–750 centistokes at room temperature.

A preferred method of preparing the face coat dip slurry comprises first mixing the metal oxide binder with the selected liquid vehicle and then dissolving or suspending the metal-forming inhibitor in the resulting mixture. The finely divided mold material next is mixed in, as are any supplemental materials which are to be included in the mix. The resulting composition then is agitated until a slurry of uniform composition is obtained.

In the application of the face coat dip slurry, the pattern first is treated with a suitable solvent, as required to remove any die release agent which may be present on its surface. It then is immersed with agitation in the face coat dip slurry and rotated to insure complete coverage. After a dwell period of from 5 to 60 seconds it is withdrawn and, typically, drained for 10 to 60 seconds.

The wet pattern assembly then normally is stuccoed with finely divided molybdenum or tungsten having a mesh size of about −60 to +150 (United States Sieve Series). In the alternative, it may be stuccoed with an oxide of a metal such as zirconium, hafnium, thorium, yttrium or gadolinium, or with a selected face coat mold material.

The dip coated and stuccoed pattern assembly then is air dried until the coat has a solvent content of below about 20% by volume. If desired, gel drying or vacuum drying techniques also may be employed supplemental to, or in lieu of, air drying.

The dried assembly next is treated with superimposed alternating dip coats and stucco coats of predetermined composition and number until a mold of the desired size and strength has been fabricated. Thereafter, the mold is heated to fluidize and remove the disposable pattern which thus has been invested to form the mold. It next must be oven dried and cured.

The mold is oven dried in either air or a non-oxidizing atmosphere at from 500° to 650° K. for 4 to 8 hours. This removes most of the low temperature volatiles.

After the drying cycle, the mold is placed in a furnace and treated with hydrogen gas for reduction of the inhibitor-former to metallic molybdenum or tungsten. The treatment with hydrogen gas preferably is effectuated in a purging environment of the latter in order to sweep out of the vicinity of the mold water vapor which usually is formed as a product of the action between the inhibitor-former and gaseous hydrogen. Such water vapor, if permitted to remain in contact with the mold, would react with the metal interface in an undesirable manner.

The hydrogen gas should be employed in an amount which is at least the stoichiometric amount required for reducing the inhibitor-former. This is desirable since, at least in the case of certain inhibitor-formers, a residue of the same left at the mold interface would cause the occurrence of undesirable side reactions between the mold and the casting metal poured therein.

The mold is heated in the hydrogen environment at a temperature and time sufficient to reduce substantially completely the inhibitor-forming compound. In the usual case, it requires heating the mold at a temperature of from 900° to 2500° K. for a time of from 2 to 4 hours. In order to prevent mold distortion or sagging, it is desirable that the final mold curing temperature be below the melting temperature of any of the mold materials which at this stage of the process still are present in the mold.

If desired, after treatment with hydrogen, the molds may be vacuum processed at high temperature in known manner.

Subjecting the molds to the action of hydrogen at high temperature serves various functions. If metallic oxide-forming binders have been employed, the heat drying converts such binders to metal oxide binders. It also removes essentially all of the remaining volatiles from the mold and provides the mold with a high temperature bond without destroying or distorting it.

Most importantly, however, from the standpoint of the present invention, the heat curing in the presence of hydrogen effects reduction of the inhibitor-former to metallic molybdenum and/or tungsten. This forms a metallic barrier at the mold interface and effectively covers the particles of face coat mold material and oxide binder. It thus inhibits reaction between the mold constituents and the reactive and refractory molten metals subsequently cast therein.

The investment shell molds of the invention and the methods for making them are illustrated further in the following examples wherein amounts are given in percent by weight.

EXAMPLE I

| | Facing Slurry | 2 | 3 | 4 and up |
|---|---|---|---|---|
| Hydrolyzed Hafnium Chloroethoxide Ethylate (32.9% $HfO_2$ in Ethanol) | 10.50 | 11.10 | 9.10 | 7.37 |
| Hydrolyzed Zirconium Chloroethoxide Ethylate (15.0% $ZrO_2$ in Ethanol) | 0 | 3.10 | 2.50 | 2.02 |
| Hydrolyzed Molybdenum Chloroethoxide Ethylate Inhibitor (8.9% $MoO_3$ in Ethanol) | 5.25 | 5.05 | 4.15 | 3.36 |
| Glycerine | 0 | 0.05 | 0.04 | 0.03 |
| Water | 0 | 1.10 | 1.45 | 1.17 |
| Denatured Ethanol | 0 | 0 | 0 | 1.96 |
| Fused Zirconium Oxide Powder (−325 mesh) | 84.25 | 79.60 | 65.35 | 52.86 |
| Fused Zirconium Oxide Grain (−20+50 mesh). | 0 | 0 | 0 | 17.15 |
| Fused Zirconium Oxide Grain (−35+80 mesh) | 0 | 0 | 17.40 | 14.05 |
| Stucco | $ZrO_2$ −100+200 | $ZrO_2$ −35+80 | $ZrO_2$ −20±50 | $ZrO_2$ −20+50 |

EXAMPLE II

| | Facing Slurry | 2 | 3 and up |
|---|---|---|---|
| Colloidal Zirconia (20% $ZrO_2$ in Water) | 12.4 | 0 | 0 |
| Diacetatozirconic Acid (22% $ZrO_2$ in Water) | 8.5 | 0 | 0 |
| Hydrolyzed Molybdenum Chloroethoxide Ethylate Inhibitor (8.9% $MoO_3$ in Ethanol) | 16.5 | 0 | 0 |
| Molybdenum Powder (−325 mesh) | 60.0 | 0 | 0 |
| Fused Gadolinium Oxide Powder (−325 Mesh) | 2.6 | 0 | 0 |
| Hydrolyzed Tetraethylorthosilicate Solution (15% $SiO_2$ in Ethanol) | 0 | 23.0 | 25.0 |
| Fused Zirconium Oxide Powder (−325 mesh) | 0 | 77.0 | 0 |
| Aluminum Silicate Powder (−325 mesh) | 0 | 0 | 50.0 |
| Aluminum Silicate Grain (−20+50 mesh) | 0 | 0 | 25.0 |
| Stucco | Molybdenum −100+200 | $ZrO_2$ −35+80 | Aluminum Silicate −20+50 |

EXAMPLE III

| | Facing Slurry | 2 | 3 and up |
|---|---|---|---|
| Hydrolyzed Tetraethylortho silicate Solution (15% $SiO_2$ in Ethanol) | 20.0 | 23.0 | 25.0 |
| Hydrolyzed Tungsten Trichloro diethoxide Inhibitor (26% $WO_3$ in Ethanol) | 7.2 | 0 | 0 |
| Fused Zirconium Oxide Powder (−325 mesh) | 72.8 | 77.0 | 0 |
| Aluminum Silicate Powder (−325 mesh) | 0 | 0 | 50.0 |
| Aluminum Silicate Grain (−20+50 mesh) | 0 | 0 | 25.0 |
| Stucco | $ZrO_2$ −100+200 | $ZrO_2$ −35+80 | Aluminum Silicate −20+50 |

EXAMPLE IV

| | Facing Slurry | 2 | 3 and up |
|---|---|---|---|
| Diacetatozirconic Acid | | | |

EXAMPLE IV-continued

| | Facing Slurry | 2 | 3 and up |
|---|---|---|---|
| (22% $ZrO_2$ in Water) | 3.0 | 0 | 0 |
| Water | 1.0 | 0 | 0 |
| Ammonium Metatungstate Inhibitor | 3.5 | 0 | 0 |
| Colloidal Tungstic Acid Inhibitor (Water Suspension containing 25% available Tungstic Oxide) | 10.0 | 0 | 0 |
| Tungsten Powder (−325 mesh) | 80.0 | 0 | 0 |
| Fused Yitrium Oxide (−325 mesh) | 2.5 | 0 | 0 |
| Hydrolyzed Tetraethylorthosilicate Solution (15% $SiO_2$ in Ethanol) | 0 | 23.0 | 25.0 |
| Fused Zirconium Oxide Powder (−325 mesh) | 0 | 77.0 | |
| Aluminum Silicate Powder (−325 mesh) | 0 | 0 | 50.0 |
| Aluminum Silicate Grain (−20+50 mesh) | 0 | 0 | 25.0 |
| Stucco | Tungsten −60+150 | $ZrO_2$ −35+80 | Aluminum Silicate −20+50 |

EXAMPLE V

| | Facing Slurry | 2 | 3 and up |
|---|---|---|---|
| Diacetatozirconic Acid (22% $ZrO_2$ in Water) | 3.0 | 3.0 | 0 |
| Water | 1.0 | 1.0 | 0 |
| Ammonium Metatungstate Inhibitor | 3.5 | 3.5 | 0 |
| Tungsten Powder (−325 mesh) | 91.5 | 91.5 | 0 |
| Fused Zirconium Oxide Powder (−325 mesh) | 1.0 | 1.0 | 0 |
| Hydrolyzed Tetraethylorthosilicate Solution (15% $SiO_2$ in Ethanol) | 0 | 0 | 25.0 |
| Aluminum Silicate Powder (−325 mesh) | 0 | 0 | 50.0 |
| Aluminum Silicate Grain (−20+50 mesh) | 0 | 0 | 25.0 |
| Stucco | $ZrO_2$ −100+200 | $ZrO_2$ −35+80 | Aluminum Silicate −20+50 |

EXAMPLE VI

| | FACING SLURRY | 2 | 3 AND UP |
|---|---|---|---|
| Diacetatozirconic Acid (22% $ZrO_2$ in Water) | 18.15 | 0 | 0 |
| Ammonium Metatungstate Inhibitor | 18.15 | 0 | 0 |
| Tungsten Dioxide Inhibitor Powder (−325 mesh) | 12.30 | 0 | 0 |
| Zirconium Silicate Powder (−325 mesh) | 51.40 | 0 | 0 |
| Hydrolyzed Tetraethylorthosilicate Solution (15% $SiO_2$ in Ethanol) | 0 | 23.0 | 25.0 |
| Fused Zirconium Oxide Powder (−325 mesh) | 0 | 77.0 | 0 |
| Aluminum Silicate Powder (−325 mesh) | 0 | 0 | 50.0 |
| Aluminum Silicate Grain (−20+50 mesh) | 0 | 0 | 25.0 |
| Stucco | Tungsten −60+150 | $ZrO_2$ −35+80 | Aluminum oxide −20+50 |

EXAMPLE VII

| | FACING SLURRY | 2 | 3 | 4 AND UP |
|---|---|---|---|---|
| Diacetatozirconic acid (22% $ZrO_2$ in water) | 14.6 | 10.5 | 8.1 | 7.60 |
| Molybdenum dioxydichloride Inhibitor | 8.9 | 6.4 | 5.5 | 4.60 |
| Fused Lanthanum Oxide Powder (−325 mesh) | 16.2 | 17.1 | 14.6 | 12.25 |
| Thorium oxide powder (−325 mesh) | 19.0 | 13.7 | 11.8 | 9.85 |
| Molybdenum powder (−325) mesh) | 41.3 | 29.8 | 25.6 | 21.40 |

EXAMPLE VII-continued

| | | FACING SLURRY | 2 | 3 | 4 AND UP |
|---|---|---|---|---|---|
| Thorium oxide grain (−20+200 mesh) | | 0 | 22.5 | 19.3 | 16.15 |
| Molybdenum grain (−100+200 mesh) | | 0 | 0 | 14.1 | 11.80 |
| Molybdenum grain (−20+50 mesh) | | 0 | 0 | 0 | 16.35 |
| | Stucco | Molybdenum −100+200 | $ThO_2$ −20+200 | $ThO_2$ −20+50 | $ThO_2$ −20+50 |

In all of the foregoing examples, the dip slurries were prepared by adding the inhibitor-forming components and the binder components to the slurry vehicle and agitating them until a solution or a fine dispersion was obtained. The mold material then was added and the mixing continued until a uniform mixture resulted.

A pattern was dipped and stuccoed alternately with the compositions until the finished mold was produced. The pattern then was removed by melting or solvent treatment, after which the mold was baked at from 500° to 650° K. for from 4 to 8 hours to remove low temperature volatiles. Thereafter, the mold was cured in a purging atmosphere of hydrogen at 900°–2500° K. for from 2 to 4 hours.

This effected the reduction of the inhibitor-forming compounds to metallic tungsten or molybdenum, as the case may be. The metal thus formed covered the surfaces of the binder and mold material components of the face coat, thereby forming a barrier capable of inhibiting subsequent reaction of these mold components with molten metallic titanium, zirconium, or other reactive and refractory metals subsequently cast in the mold.

In a manner similar to the foregoing, there are prepared inhibited molds for casting reactive and refractory metals using as inhibitor-forming components of the mold face coat one or a mixture of the following materials: tungsten dioxide, tungsten trioxide, molybdenum dioxide, molybdenum trioxide, tungstic acid, molybdic acid, ammonium metatungstate, lanthanum metatungstate, molybdenum chloroethoxide ethylate, tungsten trichloro diethoxide ethylate, molybdenum pentachloride, molybdenum oxytrichloride, dimolybdenum oxyoctachloride, dimolybdenum trioxypentachloride, molybdenum dioxydichloride, molybdenum oxytetrachloride, tungsten hexachloride, tungsten dioxydichloride, and tungsten oxytetrachloride.

Having thus described my invention in preferred embodiments, I claim:

1. For use in the precision casting of reactive and refractory metals, an investment shell mold comprising a plurality of superimposed layers of shell mold material and a binder therefor, and having complete coverage of the mold interface with a discontinuous barrier layer comprising finely divided particles of shell mold material intimately mixed with finely divided particles of a binder therefor, the particles of both shell mold material and binder being coated with at least one metal selected from the group consisting of tungsten and molybdenum, the barrier layer coating being discontinuous by having openings therethrough of a size which are substantially impenetrable by molten reactive and refractory metals to be cast in the mold.

2. The shell mold of claim 1 wherein the coating metal comprises tungsten.

3. The shell mold of claim 1 wherein the coating metal comprises molybdenum.

4. The shell mold of claim 1 wherein the shell mold material of the barrier layer comprises tungsten powder and the binder comprises a refractory metal oxide binder.

5. The shell mold of claim 1 wherein the shell mold material of the barrier layer comprises tungsten powder and the binder comprises finely divided particles of at least one refractory metal oxide binder selected from the group consisting of the oxides of zirconium, thorium, hafnium, yttrium and gadolinium.

6. The shell mold of claim 1 wherein the shell mold material of the barrier layer comprises molybdenum powder and the binder comprises a refractory metal oxide binder.

7. The shell mold of claim 1 wherein the shell mold material of the barrier layer comprises molybdenum powder and the binder comprises a refractory metal oxide binder selected from the group consisting of the oxides of zirconium, thorium, hafnium, yttrium and gadolinium.

* * * * *

UNITED STATES PATENT AND TRADEMARK OFFICE

CERTIFICATE OF CORRECTION

PATENT NO. : 3,994,346

DATED : November 30, 1976

INVENTOR(S) : Robert A. Brown

It is certified that error appears in the above-identified patent and that said Letters Patent are hereby corrected as shown below:

In the title:

Change "reacting" to --reactive--.

In the specification:

Column 1, line 15 change "inventment" to --investment--.

Column 2, line 19 change "plane" to --plan--.

Signed and Sealed this

Eighth Day of March 1977

[SEAL]

*Attest:*

RUTH C. MASON
*Attesting Officer*

C. MARSHALL DANN
*Commissioner of Patents and Trademarks*